US009599088B2

(12) United States Patent
Aoyagi

(10) Patent No.: US 9,599,088 B2
(45) Date of Patent: Mar. 21, 2017

(54) SYSTEM FOR CRANKING INTERNAL COMBUSTION ENGINE BY ENGAGEMENT OF PINION WITH RING GEAR

(71) Applicant: DENSO CORPORATION, Kariya, Aichi-pref. (JP)

(72) Inventor: Takeshi Aoyagi, Toyota (JP)

(73) Assignee: DENSO CORPORATION, Kariya (JP)

( * ) Notice: Subject to any disclaimer, the term of this patent is extended or adjusted under 35 U.S.C. 154(b) by 300 days.

(21) Appl. No.: 13/904,355

(22) Filed: May 29, 2013

(65) Prior Publication Data

US 2013/0319360 A1 Dec. 5, 2013

(30) Foreign Application Priority Data

Jun. 5, 2012 (JP) ..... 2012-127649

(51) Int. Cl.
*F02N 15/02* (2006.01)
*F02N 11/08* (2006.01)
(Continued)

(52) U.S. Cl.
CPC ..... *F02N 15/02* (2013.01); *F02N 11/0851* (2013.01); *F02N 11/106* (2013.01);
(Continued)

(58) Field of Classification Search
CPC .... F02N 11/0851; F02N 15/02; F02N 11/106; F02N 11/0855; F02N 15/06; F02N 2200/047
(Continued)

(56) References Cited

U.S. PATENT DOCUMENTS 5,568,388 A * 10/1996 Schnerer ..... B60T 8/172 701/1
6,476,573 B2 * 11/2002 Omata et al. ..... 318/445
(Continued)

FOREIGN PATENT DOCUMENTS

CN 102011667 A 4/2011
JP A-2005-330813 12/2005
JP 2012-062768 A 3/2012

OTHER PUBLICATIONS

Oct. 10, 2015 Office Action issued in Chinese Patent Application No. 201310218400.5.
(Continued)

*Primary Examiner* — Stephen K Cronin
*Assistant Examiner* — Susan E Scharpf
(74) *Attorney, Agent, or Firm* — Oliff PLC

(57) ABSTRACT

In a system, an engine restating module is capable of executing an engine restart task to crank an automatically stopped engine if an engine restart condition is met. The engine restart task includes energization of a mechanism to thereby shift a pinion to be engaged with a ring gear, and energization of a motor to rotate the pinion. A deenergizing module is capable of deenergizing the motor if an interrupting request that interrupts restart of the automatically stopped engine is generated during execution of the engine restart task. A maintaining module is capable of maintaining energization of the mechanism to engage the pinion with the ring gear even if the interrupting request that interrupts restart of the automatically stopped engine is generated during execution of the engine restart task.

7 Claims, 3 Drawing Sheets

(51) Int. Cl.
*F02N 11/10* (2006.01)
*F02N 15/06* (2006.01)

(52) U.S. Cl.
CPC ..... *F02N 11/0855* (2013.01); *F02N 15/06* (2013.01); *F02N 2200/047* (2013.01)

(58) Field of Classification Search
USPC ... 123/179.3, 179, 179.4; 701/112, 102, 113
See application file for complete search history.

(56) References Cited

U.S. PATENT DOCUMENTS

| | | | | |
|---|---|---|---|---|
| 7,003,395 | B1 * | 2/2006 | Thompson | F02N 11/0803 701/113 |
| 7,717,076 | B2 * | 5/2010 | Gandert | B60W 10/06 123/179.3 |
| 7,983,833 | B2 * | 7/2011 | Sugai | B60K 6/445 123/179.4 |
| 2010/0031911 | A1 * | 2/2010 | Gessier et al. | 123/179.21 |
| 2010/0256896 | A1 * | 10/2010 | Kitano et al. | 701/113 |
| 2010/0299053 | A1 * | 11/2010 | Okumoto et al. | 701/113 |
| 2010/0305838 | A1 * | 12/2010 | Yamamura | F02D 41/1497 701/113 |
| 2011/0056450 | A1 * | 3/2011 | Notani | 123/179.4 |
| 2011/0118962 | A1 * | 5/2011 | Couetoux et al. | 701/113 |

OTHER PUBLICATIONS

Oct. 20, 2015 Office Action issued in Japanese Patent Application No. 2012-127649.

* cited by examiner

SYSTEM FOR CRANKING INTERNAL COMBUSTION ENGINE BY ENGAGEMENT OF PINION WITH RING GEAR

CROSS REFERENCE TO RELATED APPLICATIONS

This application is based on and claims the benefit of priority from Japanese Patent Application 2012-127649 filed on Jun. 5, 2012, the disclosure of which is incorporated in its entirety herein by reference.

TECHNICAL FIELD

The present disclosure relate to systems for cranking an automatically stopped internal combustion engine by engagement of the pinion of a starter with the ring gear coupled to the output shaft of the internal combustion engine.

BACKGROUND

Engine stop and start systems, such as idle reduction control systems, have been recently developed. Such engine stop-and-start systems perform an engine stop-and-restart task. The engine stop-and restart task is designed to automatically stop an internal combustion engine of a vehicle in response to detecting a driver's engine stop operation, such as the operation of a brake pedal. The engine stop and restart task is also designed to restart the internal combustion engine (referred to simply as an engine) in response to detecting a driver's operation to start the vehicle, such as the operation of an accelerator pedal. The engine-stop-and restart task aims at reducing fuel cost, exhaust emission, and the like.

It is desirable to restart the engine as soon as possible in response to the occurrence of an engine restart request in view of improvement of the driver's drivability of the vehicle. Various technologies have been proposed for addressing such a desire.

For example, Japanese Patent Application Publication No. 2005-330813 discloses an engine stop and start system. The engine stop and start system is equipped with a starter including a pinion (pinion gear) and a motor for rotating the pinion, and also equipped with two solenoids that are drivable individually. When energized, the first solenoid causes the pinion to shift to a ring gear coupled to an output shaft of the engine to be engaged therewith. When energized, the second solenoid causes the pinion of the motor to be rotated while the pinion is engaged with the ring gear, thus restarting the engine.

SUMMARY

While the pinion, which is engaged with the ring gear, is rotated by the motor so that rotational energy for restart of the engine is transferred to the engine, a request to interrupt restart of the engine may be generated. For example, while rotational energy is transferred to the engine for restart of the engine, activation of an ABS (Antilock Brake System) may generate a request to interrupt restart of the engine. Specifically, large power consumption of the ABS and the starter could result in shortage of power supply if the ABS and starter were simultaneously energized. Thus, when the ABS is activated, the engine stop-and-start system shuts off power supply to the starter to interrupt restart of the engine.

After disengagement of the pinion with the ring gear based on interruption of restart of the engine, the pinion and ring gear continuously coast, i.e. turn without the aid of the engine. Because resistance to rotation of the pinion is smaller than that to rotation of the ring gear, the pinion coasts for a period longer than a period for which the ring gear coasts. Thus, reengagement of the pinion with the ring gear may be difficult until there is no rotation of the pinion. This may result in difficulty to restart the engine again after interruption of restart of the engine, resulting in delay of completion of restarting the engine despite the driver's request.

In view of the circumstances set forth above, one aspect of the present disclosure seeks to provide a system for cranking an automatically stopped internal combustion engine, which is designed to solve the problem set forth above.

Specifically, an alternative aspect of the present disclosure aims to provide such a system, which is capable of restarting the automatically stopped internal combustion engine again as soon as possible after interruption of restart of the automatically stopped internal combustion engine.

According to an exemplary aspect of the present disclosure, a system for cranking an internal combustion engine with an output shaft to which a ring gear is coupled using a starter. The starter includes a mechanism that shifts a pinion to the ring gear to be engageable with the ring gear when energized, and a motor that rotates the pinion when energized. The system includes an engine restating module capable of executing an engine restart task to crank the automatically stopped internal combustion engine if an engine restart condition is met, the engine restart task including energization of the mechanism to thereby shift the pinion to be engaged with the ring gear, and energization of the motor to rotate the pinion. The system includes a deenergizing module capable of deenergizing the motor if an interrupting request that interrupts restart of the internal combustion engine is generated during execution of the engine restart task. The system includes a maintaining module capable of maintaining energization of the mechanism to engage the pinion with the ring gear even if the interrupting request that interrupts restart of the internal combustion engine is generated during execution of the engine restart task.

In the system according to the exemplary aspect of the present disclosure, engagement of the pinion with the ring gear is continued while the motor is deenergized even if the interrupting request is generated during execution of the engine restart task. This makes the rotational speed of the pinion remain in agreement with that of the ring gear. This results in elimination of the disadvantage of a long wait for start of the next engine restart until the coasting of the pinion is stopped. Thus, it is possible to restart the internal combustion engine as soon as possible in response to re-request of restart of the internal combustion engine after interruption of restart of the internal combustion engine.

As one of factors of interruption of restart of the internal combustion engine, there is a situation in which an actuator, such as a brake actuator, should be activated with a higher priority in comparison to restart of the internal combustion engine. In this situation, deenergization of the motor allows electrical power to be preferentially supplied to the actuator, making it possible to properly drive the actuator.

BRIEF DESCRIPTION OF THE DRAWINGS

Other aspects of the present disclosure will become apparent from the following description of an embodiment with reference to the accompanying drawings in which.

DETAILED DESCRIPTION OF EMBODIMENT

An embodiment of the present invention will be described hereinafter with reference to the accompanying drawings.

In this embodiment, the present disclosure includes an engine stop and start system designed as a part of a vehicle control system 1 installed in a motor vehicle.

The vehicle control system 1 is operative to perform engine control and brake control of the motor vehicle. The engine control includes control of the quantity of fuel to be sprayed and the timing of ignition, and stop and restart control of an internal combustion engine (referred to simply as an engine) 20. An example of the overall structure of the vehicle control system 1 is illustrated in FIG. 1.

Figure 1:
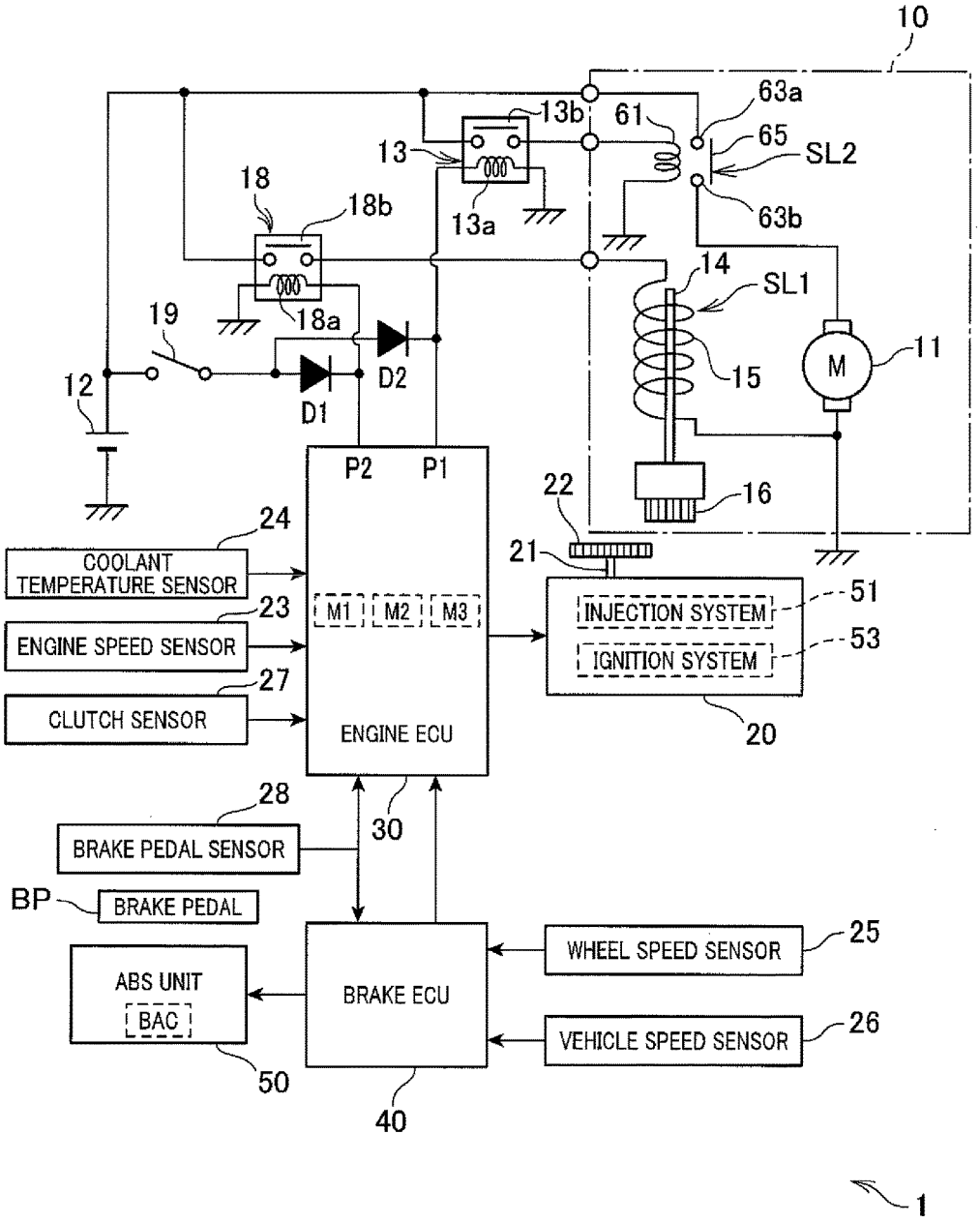
FIG. 1 is a view schematically illustrating an example of the overall hardware structure of a vehicle control system according to an embodiment of the present disclosure.

Referring to FIG. 1, the engine 20 has a crankshaft 21 as an output shaft thereof, with one end to which a ring gear 22 is directly or indirectly coupled. The crankshaft 21 is coupled to the piston via a connection rod within each cylinder such that travel of the piston in each cylinder up and down allows the crankshaft 21 to be turned.

Specifically, the engine 20 works to compress air-fuel mixture or air by the piston within each cylinder and burn the compressed air-fuel mixture or the mixture of the compressed air and fuel within each cylinder. This changes the fuel energy to mechanical energy, such as rotational energy, to reciprocate the piston within each cylinder, thus rotating the crankshaft 21. The rotation of the crankshaft 21 is transferred through a clutch and a manual transmission (not shown) to a driving shaft (not shown) to which driving wheels (not shown) are attached, thus driving the motor vehicle.

The engine 20 is installed with, for example, a fuel injection system 51 and an ignition system 53.

The fuel injection system 51 includes actuators, such as fuel injectors, and causes the actuators to spray fuel either directly into each cylinder of the engine 20 or into an intake manifold (or intake port) just ahead of each cylinder thereof to thereby burn the air-fuel mixture in each cylinder of the engine 20.

The ignition system 53 includes actuators, such as igniters, and causes the actuators to provide an electric current or spark to ignite an air-fuel mixture in each cylinder of the engine 20, thus burning the air-fuel mixture.

When the engine 20 is designed as a diesel engine, the ignition system 53 can be eliminated.

The crankshaft 21 is coupled to a piston via a connection rod within each cylinder such that travel of the piston in each cylinder up and down allows the crankshaft 21 to be turned.

Referring to FIG. 1, the vehicle control system 1 includes a starter 10, a chargeable battery 12, a first drive relay 18, a second drive relay 13, a first diode D1, and a second diode D2.

The starter 10 is comprised of a starter motor (motor) 11, a pinion shaft 14, a pinion 16, a solenoid actuator SL1 including a solenoid 15, and a motor switch SL2.

The motor 11 is, for example, a DC motor made up of an output shaft coupled to the pinion shaft 14, and an armature coupled to the output shaft.

The motor 11 is made up of an output shaft coupled to the pinion shaft 14, and an armature coupled to the output shaft and electrically connected to the motor switch SL2. The motor switch SL2 is comprised of a solenoid 61, a pair of stationary contacts 63*a* and 63*b*, and a movable contact 65. The stationary contact 63*a* is electrically connected to a positive terminal of the battery 12 whose negative terminal is grounded, and the stationary contact 63*b* is electrically connected to the armature of the motor 11.

The starter 10 designed such that the pinion shaft 14 is shiftable together with the pinion 16 in its axial direction. The motor 11 is arranged to be opposite to the engine 20 such that the shift of the pinion 16 in the axial direction of the pinion shaft 14 toward the engine 20 allows a tooth section of the pinion 16 to abut on a tooth section of the ring gear 22 of the engine 20 and to be meshed therewith.

The solenoid 15 is wound around the pinion shaft 14. One end of the solenoid 15 is electrically connected to the positive terminal of the battery 12 via the first drive relay 18, and the other end thereof is grounded.

The first drive relay 18 is comprised of, for example, a solenoid 18*a* and a switch 18*b*. As the first drive relay 18, a semiconductor relay can be used. A first end of the solenoid 18*a* is electrically connected to an output port P2 of the engine ECU 30 and to an ignition switch 19 through the first diode D1, and a second end opposite to the first end is grounded. The ignition switch 19 is provided in the motor vehicle, and is electrically connected to the positive terminal of the battery 12.

When the ignition switch 19 is turned on by an operation of the driver, the battery 12 supplies electric power to the solenoid 18*a* via the first diode D1 as an engine starting signal so that the solenoid 18*a* is energized.

The switch 18*b* is electrically connected between the positive terminal of the battery 12 and the solenoid 15. The switch 18*b* is turned on (closed) by magnetic force generated when the solenoid 18*a* is energized. This energizes the solenoid actuator SL1.

When energized, the solenoid actuator SL1 works to shift the pinion 16 and the pinion shaft 14 to the ring gear 22. This allows the pinion 16 to be meshed with the ring gear 22 for cranking the engine 20.

Otherwise, while the ignition switch 19 is off, the solenoid 18*a* is deenergized so that the switch 18*b* is off, resulting in deenergization of the solenoid actuator SL1.

When the solenoid actuator SL1 is deenergized, a return spring (not shown) returns the pinion 16 and the pinion shaft 14 in the direction opposite to the direction toward the ring gear 22, so that the pinion 16 is disengaged with the ring gear 22.

The second drive relay 13 is comprised of, for example, a solenoid 13*a* and a switch 13*b*. As the second drive relay 13, a semiconductor relay can be used.

A first end of the solenoid 13*a* is electrically connected to an output port P1 of the engine ECU 30 and to the ignition switch 19 through the second diode D2, and a second end opposite to the first end is grounded.

When the ignition switch 19 is turned on by an operation of the driver, the battery 12 supplies electric power to the solenoid 13*a* via the second diode D2, resulting in that the solenoid 13*a* is energized.

The switch 13*b* is electrically connected between the positive terminal of the battery 12 and a first end of the solenoid 61 whose second end opposite to the first end is grounded. The switch 13*b* is turned on (closed) by magnetic force generated when the solenoid 13*a* is energized. This results in energization of the solenoid 61.

Energization of the solenoid 61 causes the movable contact 65 to abut onto the pair of stationary contacts 63*a* and 63*b* so that the motor switch SL2 is turned on, resulting in energization of the armature of the motor 11 by the battery 12. This causes the motor 11 to rotate the output shaft together with the pinion shaft 14, thus rotating the pinion 16.

Otherwise, while the ignition switch 19 is off, the solenoid 13*a* is deenergized so that the switch 13*b* is off, resulting in deenergization of the solenoid 61. While the ignition switch 19 is off or is not positioned at a starter-ON position, the second drive relay 13 is off.

When the solenoid 61 is deenergized during the output shaft of the motor 11 being turned, the movable contact 65 is separated from the pair of stationary contacts 63*a* and 63*b* so that the motor switch SL2 is turned off, resulting in deenergization of the armature of the motor 11. This causes the motor 11 to stop rotation of the output shaft and the pinion shaft 14, thus stopping rotation of the pinion 16.

In addition, the vehicle control system 1 includes an engine ECU 30, a brake ECU 40, an ABS unit 50, and, as means for measuring the operating conditions of the engine 20 and the driving conditions of the motor vehicle, various types of sensors. Specifically, the sensors, for example, include an engine speed sensor 23 (i.e., a crank angle sensor), a coolant temperature sensor 24, wheel speed sensors 25, a vehicle speed sensor 26, a clutch sensor 27, and a brake-pedal sensor 28.

The engine speed sensor 23 is operative to output, to the engine ECU 30, a signal indicative of the rotational speed of the crankshaft 21 of the engine 20, referred to as an engine speed NE.

The coolant temperature sensor 24 is operative to measure the temperature of an engine coolant inside the engine 20, and to output, to the engine ECU 30, a signal indicative of the measured temperature.

Each of wheel speed sensors 25 is located to be close to a corresponding one of the wheels of the motor vehicle. Each of the wheel speed sensors 25 is operative to measure the rotational speed of a corresponding one of the wheels, and output, to the brake ECU 40, a signal indicative of the measured rotational speed of a corresponding one of the wheels.

The vehicle speed sensor 26 is operative to measure the speed of the motor vehicle, and output, to the brake ECU 40, a signal indicative of the measured speed of the motor vehicle.

The clutch sensor 27 is operative to measure a driver's operated stroke of the clutch pedal, and output, to the engine ECU 30, a signal indicative of the measured driver's operated stroke of the clutch pedal.

The brake-pedal sensor 28 is operative to measure a driver's operated (depressed) position or stroke of a brake pedal BP, and output, to the engine ECU 30 and the brake ECU 40, a signal indicative of the measured driver's operated position or stroke of the brake pedal BP.

Specifically, when the clutch pedal is depressed by the driver, the clutch is disengaged to disconnect the engine 20 from the manual transmission. This disconnection shuts off the transfer of rotational power based on the rotation of the crankshaft 21 to the manual transmission; this state allows the motor vehicle to change a gear ratio of the manual transmission.

In contrast, when the depressed clutch pedal is released by the driver, the clutch is engaged to connect the engine 20 to the manual transmission to thereby allow the transfer of the rotational power based on the rotation of the crankshaft 21 to the manual transmission.

The ABS unit 50 is operative to control hydraulic pressure to be applied, via a brake actuator BAC, to each wheel according to the signal supplied from the brake-pedal sensor 28 to thereby brake the motor vehicle while preventing any wheel from locking up.

The engine ECU 30 is designed as, for example, a normal microcomputer circuit consisting of, for example, a CPU, a storage medium including a nonvolatile memory, an IO (Input and output) interface, and so on. The normal microcomputer circuit is defined in this embodiment to include at least a CPU and a main memory, such as the storage medium therefor.

The engine ECU 30 is programmed to:

receive the signals outputted from the sensors; and control, based on the operating conditions of the engine 20 determined by at least some of the received signals from the sensors, various actuators installed in the engine 20 to thereby perform various engine control tasks.

For example, the various engine control tasks include a fuel injection control task, i.e. an injection-quantity control task and an ignition timing control task, and an engine stop-and-restart task including a starter control task.

The fuel injection control task is designed to:

adjust a quantity of intake air into each cylinder;

compute a proper fuel injection timing and a proper injection quantity for the fuel injector for each cylinder and a proper ignition liming for the igniter for each cylinder;

instruct the fuel injector for each cylinder to spray, at a corresponding computed proper injection timing, a corresponding computed proper quantity of fuel into each cylinder; and instruct the igniter for each cylinder to ignite the compressed air-fuel mixture or the mixture of the compressed air and fuel in each cylinder at a corresponding computed proper ignition liming.

The brake ECU 40 is designed as, for example, a normal microcomputer circuit consisting of, for example, a CPU, a storage medium including a nonvolatile memory, an IO (Input and output) interface, and so on. The normal microcomputer circuit is defined in this embodiment to include at least a CPU and a main memory, such as the storage medium therefor.

The brake ECU 40 is operative to:

receive the signals outputted from the wheel speed sensors 25 and the vehicle speed sensor 26;

determine whether each of the wheels are locking up during braking;

instruct the ABS unit 50 to reduce the hydraulic pressure to one or more of the wheels to prevent the one or more wheels from locking up while turning a restart disabling flag, which is a bit of 0 or 1, stored in the storage medium from OFF to ON, i.e. turned from 0 to 1; and inform the engine ECU 30 of the information that the restart disabling flag is turned from OFF to ON.

Next, the engine stop-and-restart task including the starter control task will be described hereinafter.

The engine ECU 30 performs the engine stop-and-restart task to repeatedly determine whether at least one of predetermined engine automatic-stop conditions is met, in other words, whether an engine automatic-stop request (idle reduction request) occurs based on the signals outputted from the sensors.

Upon determination that no predetermined engine automatic-stop conditions are met, the engine ECU 30 exits the engine stop-and-restart task.

Otherwise, upon determination that a predetermined engine automatic-stop condition is met, the engine ECU 30 carries out an engine automatic stop task. For example, the engine ECU 30 controls the fuel injection system 51 to stop the supply of fuel, i.e. cut fuel, into each cylinder, thus stopping the burning of the air-fuel mixture in each cylinder. This results in automatic stop of the engine 20.

The predetermined engine automatic-stop conditions include, for example, the following conditions that:

the driver's operated stroke of an accelerator pedal (not shown) is zero (the driver completely releases the accelerator pedal) so that the engine 20 is in an idling state;

a brake pedal BP is depressed by the driver; and the vehicle speed is equal to or lower than a preset speed.

The automatic stop of the engine 20 causes the crankshaft 21 to coast, i.e. turn without the aid of the engine 20, so that the engine speed NE drops in a forward direction.

After the automatic stop of the engine 20, the engine ECU 30 determines whether at least one of predetermined engine restart conditions is met, that is, an engine restart request occurs, based on the signals outputted from the sensors. The predetermined engine restart conditions include, for example, the following conditions that:

release of the fully depressed clutch pedal is started;

the accelerator pedal is depressed by the driver;

the driver's operated stroke of the brake pedal BP is zero, i.e. the driver completely releases the brake pedal BP; and the driver's steering operation is performed.

For example, if start of releasing the fully depressed clutch pedal is measured by the clutch sensor 27 while the engine 20 is stopped, the engine ECU 30 determines that the corresponding engine restart condition is satisfied, then performing the starter control task to restart the engine 20.

Specifically, when at least one of the engine restart conditions is met during drop of the engine speed NE after automatic stop of the engine 20, the engine ECU 30 is programmed to drive the starter 10 to crank the engine 20.

Next, the starter control task included in the engine stop-and-restart task will be described hereinafter.

As described above, the engine ECU 30 has the output port P1 for outputting on/off command signals to the second drive relay 13, and the output port P2 for outputting on/off command signals to the first drive relay 18.

Specifically, when the on command signal is sent from the engine ECU 30 via the output port P2, the solenoid 18*a* is energized so that the switch 18*b* is turned on. This automatically establishes, during the on command signal being inputted thereto, electric conduction between the battery 12 and the solenoid 15 independently of the selected state of a starter switch (not shown), thus energizing the solenoid actuator SL1. In contrast, when the off command signal is sent from the engine ECU 30 via the output port P2, the solenoid 18*a* is kept in an off state, so that the switch 18*b* is kept in an off state. Thus, the solenoid actuator SL1 is kept in a deenergized state.

Similarly, when the on command signal is sent from the engine ECU 30 via the output port P1, the solenoid 13*a* is energized so that the switch 13*b*, i.e. the motor switch SL2, is turned on. This automatically establishes, during the on command signal being inputted thereto, electric conduction between the battery 12 and the armature of the motor 11 independently of the selected state of the starter switch, thus activating the motor 11. In contrast, when the off command signal is sent from the engine ECU 30 via the output port P1, the solenoid 13*a* is kept in an off state, so that the switch 13*b*, i.e. the motor switch SL2, is kept in an off state. Thus, the motor 11 is kept in a deactivated state.

In other words, the engine ECU 30 selects the on or off command signal to be output from each of the output ports P1 and P2, thus individually switching between the energized state and the deenergized state of the solenoid 15, and individually switching between the activated state and the deactivated state of the motor 11.

In this embodiment, if an engine restart condition is met during the period that the engine speed NE drops after automatic stop of the engine 20, the engine ECU 30 has a function of instructing the starter 10 to crank the engine 20 without waiting complete stop of rotation of the crankshaft 21 of the engine 20. As one example of the function, the engine ECU 30 is programmed to carry out a motor pre-drive mode, i.e. a pinion pre-rotation mode, if a value of the engine speed at the timing when an engine restart condition is met is equal to or higher than a preset threshold. The motor pre-drive mode is designed to control energization of the motor 11 and the solenoid 15 such that the pinion 16, which is rotating by the motor 11, is engaged with the ring gear 22.

Specifically, in the motor pre-drive mode, the engine ECU 30 predicts, based on previous and current values of the engine speed NE obtained from the engine speed sensor 23, future values of the engine speed NE during drop of the engine speed NE after automatic stop of the engine 20. Based on the predicted future values of the engine speed NE, the engine ECU 30 controls engagement timing of the pinion 16 with the ring gear 22.

For example, the engine ECU 30 starts to energize the motor 11 at a proper timing after an engine restart condition is met to increase the rotational speed of the pinion 16. The engine ECU 30 also calculates, based on the predicted future values of the engine speed NE, a first time point at which the absolute value of the difference between the peripheral speed of the tooth section of the ring gear 22 and that of the tooth section of the pinion 16 is equal to or lower than a preset value.

Then, the engine ECU 30 calculates a second time point prior to the first time point by a time required for the pinion 16 to abut onto the ring gear 22 from start of energization of the solenoid 15; the time will be referred to as an engagement time. The engine ECU 30 energizes, via the first drive relay 18, the solenoid 15 at the calculated second time point to start to shift the pinion 16 towards the ring gear 22. This engagement of the solenoid 15 results in energization of the pinion 16 with the ring gear 22 with the absolute value of the difference between the peripheral speed of the tooth section of the ring gear 22 and that of the tooth section of the pinion 16 being equal to or lower than the preset value. Note that the timing to start energization of the motor 11 can be set to the timing at which an engine restart condition is met or a timing calculated based on the future values of the engine speed NE.

Activation of the ABS unit 50 after engagement of the pinion 16 with the ring gear 22 before completion of restart of the engine 20 may cause cranking of the engine 20 by the starter 10 to be interrupted. The reason is as follows.

Specifically, large power consumption of the ABS unit 50 and the starter 10 could result in shortage of power supply if the ABS unit 50 and starter 10 were simultaneously energized. The shortage of power supply could cause the ABS unit 50 and the starter 10 not to operate normally. Thus, if the ABS unit 50 is requested to be activated after engagement of the pinion 16 with the ring gear 22 before completion of restart of the engine 20, the starter 10 is shut down to prioritize activation of the ABS unit 50 for running safety, resulting in interruption of restart of the engine 20.

Disengagement of the pinion 16 with the ring gear 22 due to interruption of restart of the engine 20 causes the pinion 16 and the ring gear 22 to coast. Because resistance to rotation of the pinion 16 is smaller than that to rotation of the ring gear 22, the pinion 16 coasts for a period longer than a period for which the ring gear 22 coasts. Thus, reengagement of the pinion with the ring gear may be difficult until there is no difference between the peripheral speed of the tooth section of the pinion 16 and that of the tooth section of the ring gear 22, i.e. there is no rotation of the pinion 16. This may result in difficulty in restarting the engine 20 again after interruption of restart of the engine 20, resulting in delay of completion of restarting the engine 20, despite the driver's request.

In view of the circumstances, the engine ECU 30 according to this embodiment is configured to, while the pinion 16 is engaged with the ring gear 22 during interruption of restart of the engine 20, i.e. during shut off power supply to the motor 11, control the first drive relay 18 to energize the solenoid 15 to thereby continue engagement of the pinion 16 with the ring gear 22. At that time, energization of the solenoid 15 is continued with deenergization of the motor 11 while the ABS unit 50 operates. Because of smaller power consumption of the solenoid 15 in comparison to power consumption of the motor 11, even if energization of the solenoid 15 is continued, the ABS unit 50 operates without any trouble.

After interruption of restart of the engine 20, i.e. after shutoff of power supply to the motor 11, if it is determined that one of the rotational speed, i.e. the coasting speed, of the pinion 16 and the rotational speed, i.e. the coasting speed, of the ring gear 22 becomes 0 [rpm], the engine ECU 30 controls the first drive relay 18 to thereby deenergize the solenoid 15. This is because, if one of the rotational speeds, i.e. the coasting speed of the pinion 16 or the coasting speed of the ring gear 22 becomes 0 [rpm], engagement of the pinion 16 with the ring gear 22 is maintained. In addition, if it is determined that each of the rotational speed, i.e. the coasting speed, of the pinion 16 and the rotational speed, i.e. the coasting speed, of the ring gear 22 becomes 0 [rpm] after interruption of restart of the engine 20, i.e. after shutoff of power supply to the motor 11, energization of the solenoid 15 permits the pinion 16 and the ring gear 22 to be easily engaged with each other. Thus, after engagement of the pinion 16 with the ring gear 22, energization of the motor 11 makes it possible to easily crank the engine 20.

Figure 2:
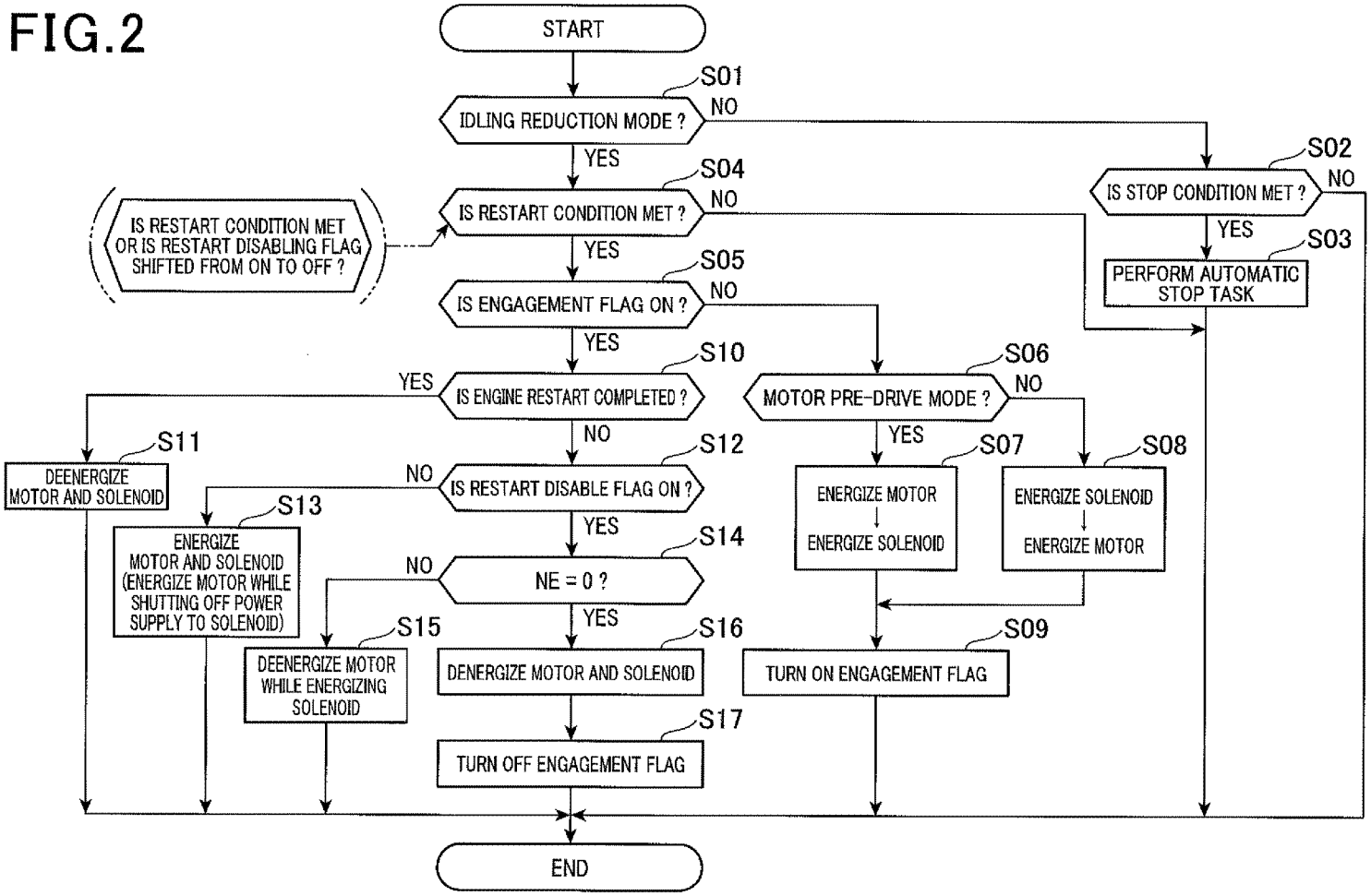
FIG. 2 is a flowchart schematically illustrating an engine stop-and-restart task tine carried out by an engine ECU according to the embodiment.

Next, the engine stop-and-restart task carried out by the engine ECU 30 will be described in detail with reference to FIG. 2. FIG. 2 schematically illustrates the engine stop-and-restart task in accordance with a corresponding program stored in the storage medium of the ECU 30. The engine ECU 30 is programmed to cyclically run the idling reduction task.

First, in step S01, the engine ECU 30 determines whether the engine ECU 30 is operating in an idling reduction mode. If automatic stop of the engine 20 was performed in response to an engine automatic-stop condition being met, so that the engine ECU 30 waits for an engine restart condition being met, it is determined that the engine ECU 30 is operating in the idling reduction mode (YES in step S01). Then, the engine ECU 30 carries out the operation in step S04.

Otherwise, if it is determined that the engine ECU 30 is not operating in the idling reduction mode (NO in step S01), the engine ECU 30 determines whether an engine automatic-stop condition is met in step S02. Upon determination that no engine automatic-stop conditions are met (NO in step S02), the engine ECU 30 terminates the engine stop-and-restart task. Otherwise, upon determination that an engine automatic-stop condition is met (YES in step S02), the engine ECU 30 carries out the engine automatic stop task set forth above in step S03. Specifically, the engine ECU 30 controls the fuel injection system 51 to cut fuel into each cylinder, thus automatically stopping the engine 20 in step S02. Thereafter, the engine ECU 30 terminates the engine stop-and-restart task.

On the other hand, in step S04, the engine ECU 30 determines whether an engine restart condition is met. Upon determination that no engine restart conditions are met (NO in step S04), the engine ECU 30 terminates the engine stop-and-restart task. Otherwise, upon determination that an engine restart request is met (YES in step S04), the engine ECU 30 determines whether an engagement flag, which is a bit with value 0 or 1 and stored in the storage medium, is set to ON, i.e. set to 1 in step S05. The engagement flag being set to 0 represents that the pinion 16 is disengaged with the ring gear 22, and the engagement flag being set to 1 represents that the pinion 16 is engaged with the ring gear 22. Note that an initial value of the engagement flag is set to 0, i.e. set to OFF.

Upon determination that the engagement flag is set to OFF (NO in step S05), the engine ECU 30 performs an engagement task between the pinion 16 and the ring gear 22 in steps S06 to S09. In this embodiment, the engine ECU 30 selects, based on the relationship between how the engine 20 is rotated and how the pinion 16 is rotated, the motor pre-drive mode set forth above or a motor post-drive mode that energizes the solenoid 15 before energizing the motor 11, and performs the engagement task in the selected one of the motor pre-drive mode and the motor post-drive mode.

Specifically, in step S06, the engine ECU 30 determines whether to perform the engagement task in the motor pre-drive mode. In the first embodiment, a reference engine speed NEref at which the pinion 16 can be engaged with the ring gear 22 is previously determined based on, for example, the rotational speed of the motor 11 when cranking the engine 20, and the gear ratio between the pinion 16 and the ring gear 22. If a value of the engine speed at the timing when an engine restart condition is met is equal to or higher than the reference engine speed NEref (YES in step S06), the engine ECU 30 determines to perform the engagement task in the motor pre-drive mode, and therefore, the engine ECU 30 performs the operation in step S07. Otherwise, if a value of the engine speed at the timing when an engine restart condition is met is lower than the reference engine speed NEref (NO in step S06), the engine ECU 30 determines to perform the engagement task in the motor post-drive mode, and therefore, the engine ECU 30 performs the operation in step S08.

In step S07, the engine ECU 30 turns on the first drive relay 18 to energize the motor 11, thus rotating the motor 11. In step S07, after energization of the motor 11, the engine ECU 30 turns on the second drive relay 13 to energize the solenoid 15 at the second time point prior to the first time point by the engagement time; the first time point represents a time point at which the absolute value of the difference between the peripheral speed of the tooth section of the ring gear 22 and that of the tooth section of the pinion 16 is equal to or lower than the preset value.

Thus, in step S07, the pinion 16 is engaged with the ring gear 22 during drop of the engine speed NE.

In contrast, in step S08, the engine ECU 30 performs engagement of the pinion 16 with the ring gear 22 while the engine speed NE becomes 0 [rpm]. Specifically, in step S08, the engine ECU 30 turns on the second drive relay 13 to energize the solenoid 15. This shifts the pinion 16 to the ring gear 22 to be engaged therewith. Thereafter, the engine ECU 30 turns on the first drive relay 18 to energize the motor 11, thus rotating the motor 11.

After execution of the operation in step S07 or that in step S08, the engine ECU 30 turns the engagement flag from OFF to ON in step S09, and thereafter, terminates the engine stop-and-restart task.

If the engagement flag is set to ON after an engine restart condition is met, i.e. if engagement of the pinion 16 with the ring gear 22 has been completed (YES in step S05), the engine ECU 30 determines whether engine restart is completed in step S10. Upon determination that engine restart is completed (YES in step S10), the engine ECU 30 turns off each of the first and second drive relays 18 and 13 to thereby deenergize the motor 11 and solenoid 15, thus terminating cranking of the engine 20 in step S11. This results in termination of the engine stop-and-restart task.

Otherwise, upon determination that engine restart is not completed (NO in step S10), the engine ECU 30 determines whether the restart disabling flag, which has been informed from the brake ECU 40, is set to ON in step S12. Upon determination that the restart disabling flag is set to OFF (NO in step S12), the engine ECU 30 turns on each of the first and second drive relays 18 and 13 to thereby energize the motor 11 and solenoid 15, terminating the engine stop-and-restart task in step S13. Note that, in step S13, if the motor 11 and solenoid 15 has been energized, the engine ECU 30 maintains the energized state of the motor 11 and solenoid 15.

Otherwise, upon determination that the restart disabling flag is set to ON (YES in step S12), the engine ECU 30 determines whether the engine speed NE has been 0 [rpm] in step S14. Upon determination that the engine speed NE has not been 0 [rpm] (NO in step S14), the engine ECU 30 turns off the second drive relay 13 while maintaining the first drive relay 18 in the on state, thus deenergizing the motor 11 while maintaining the solenoid 15 energized, terminating the engine stop-and-restart task. The operation in step S15 causes the pinion 16 and the ring gear 22 to coast with engagement between the pinion 16 and the ring gear 22.

Otherwise, upon determination that the engine speed NE has been 0 [rpm] (YES in step S14), the engine ECU 30 turns off each of the first and second drive relays 18 and 13 to thereby deenergize the motor 11 and solenoid 15, thus terminating cranking of the engine 20 in step S16. That is, in step S16, because of easy engagement of the pinion 16 with the ring gear 22 while the engine speed NE has been 0 [rpm], engagement of the pinion 16 with the ring gear 22 becomes unnecessary. For this reason, in step S16, the engine ECU 30 deenergizes the motor 11 and solenoid 15.

Following the operation in step S16, the engine ECU 30 turns the engagement flag from ON to OFF in step S17, and thereafter, terminates the engine stop-and-restart task.

Figure 3:
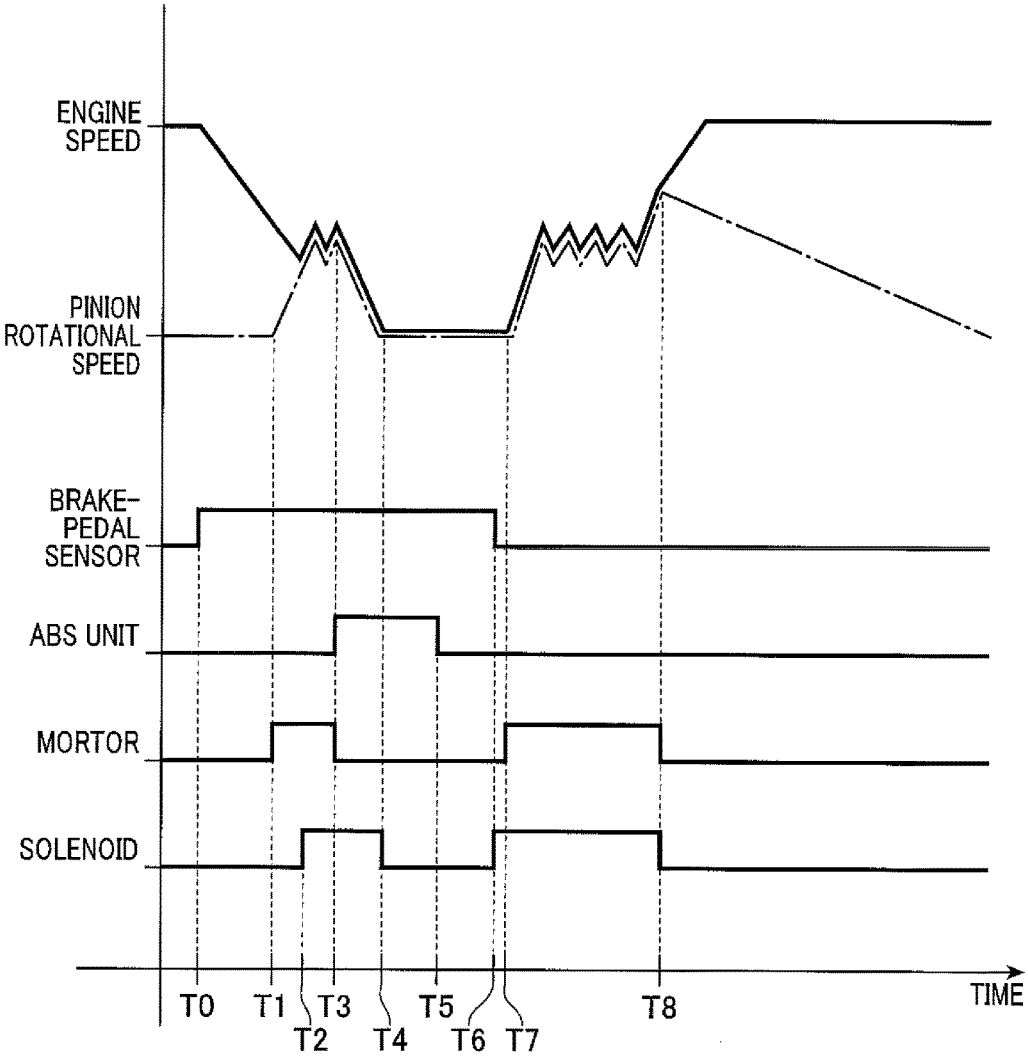
FIG. 3 is a timing chart schematically illustrating operations of the engine ECU during execution of the engine stop-and-restart task according to the embodiment.

FIG. 3 is a timing chart schematically illustrating operations of the vehicle control system 1 during execution of the engine stop-and-restart task according to this embodiment.

In FIG. 3, when the brake pedal BP is depressed by the driver at time T0, so that the signal output from the brake-pedal sensor 28 is shifted to a high level at the time T0. Based on the signal output from the brake-pedal sensor 28, it is determined that an engine automatic-stop condition is met (see YES in step S02 in FIG. 2), so that the engine automatic stop task is carried out (see step S03). This reduces the engine speed NE.

Thereafter, an engine restart condition, which is independent of the brake pedal BP, such as a condition of the driver's operation of the steering wheel, is met at time T1 (see YES in step S04). At the time T1, because the engagement flag is set to OFF, and a value of the engine speed NE is equal to or higher than the reference engine speed NEref (NO in step S05, YES in step S06), the engagement task in the motor pre-drive mode is carried out. Thus, the motor 11 is energized at the time T1, and thereafter, the solenoid 15 is energized at time T2 (see step S07). The works of the motor 11 and the solenoid 15 complete engagement of the pinion 16 with the ring gear 22, resulting in the starter 10 cranking the engine 20.

Thereafter, at time T3, when determining that there is a risk of one or more wheels locking up, the brake ECU 40 instructs the ABS unit 50 to reduce the hydraulic pressure to the one or more of the wheels to prevent the one or more wheels from locking up while changing the restart disabling flag from OFF to ON. Then, the brake ECU 40 informs the engine ECU 30 of the information that the restart disabling flag is set to ON.

After the restart flag is set to ON at the time T3, the motor 11 is deenergized while the engine speed NE is higher than 0 [rpm] (see NO in step S14). At that time, because energization of the solenoid 15 is continued (see step S15), engagement of the pinion 16 with the ring gear 22 is continued (see the period from the time T3 to time T4).

Thereafter, when the engine speed NE becomes 0 [rpm] at the time T4, the solenoid 15 is deenergized (see YES in step S14 and step S16). This causes the pinion 16 to be disengaged with the ring gear 22, so that the engagement flag is set to OFF. Thereafter, when determining that there are no risks of one or more wheels locking up, the brake ECU 40 instructs the ABS unit 50 to cancel reducing the hydraulic pressure to the one or more of the wheels, and turns the restart disabling flag from ON to OFF at time T5. Then, the brake ECU 40 informs the engine ECU 30 of the information that the restart disabling flag is set to OFF at the time T5.

Thereafter, the driver's depression of the brake pedal BP is released at time T6, so that the signal output from the brake-pedal sensor 28 is shifted to a low level at the time T6. Based on the signal output from the brake-pedal sensor 28, it is determined that an engine restart condition is met (see YES in step S04) at the time T6. At that time, because the engagement flag is set to OFF and the engine speed NE has been 0 [rpm] lower than the reference engine speed NEref (see NO in each of steps S05 and S06), the engagement task in the motor post-drive mode is carried out (see step S08). Thus, the solenoid 15 is energized at the time T6 so that the pinion 16 is engaged with the ring gear 22. Thereafter, the motor 11 is energized at time T7, resulting in the starter 10 cranking the engine 20 at the time T7.

Thereafter, when the engine speed NE has reached a predetermined value at which it is determined that the engine 20 can perform self-ignition without the aid of the starter 10 at time T7, the motor 11 and the solenoid 15 are deenergized at the time T8.

In FIG. 1, the engine ECU 30 includes an engine restarting module M1, which serves as performing, for example, the operations in steps S04 to S09, and a deenergizing module M2, which serves as performing, for example, the operations in steps S12 and S13. The engine ECU 30 also includes a maintaining module M3, which serves as performing, for example, the operation in steps S14, S15, and S16.

As described above, the vehicle control system 1 according to this embodiment is configured to continue engagement of the pinion 16 with the ring gear 22 while deenergizing the motor 11 in response to an interrupt request during execution of restart of the engine 20. This makes the rotational speed of the pinion 16 kept in agreement with that of the ring gear 22. This results in elimination of the disadvantage of a long wait for start of the next engine restart until the coasting of the pinion 16 is stopped. Thus, it is possible to restart the engine 20 as soon as possible in response to re-request of restart of the engine 20 after interruption of restart of the engine 20.

As one of factors of interruption of restart of the engine 20, there is a situation in which an actuator ins ailed in the engine 20, such as the brake actuator BAC, should be activated with a higher priority in comparison to restart of the engine 20 in the event of an urgent matter, such as the recognition of a risk to one or more wheels locking up. In this situation, deenergization of the motor 11 allows electrical power to be preferentially supplied to the actuator, making it possible to properly drive the actuator.

The vehicle control system 1 according to this embodiment is configured such that stopping rotation of the ring gear 22 with engagement of the ring gear 22 with the pinion 16 results in stopping rotation of the pinion 16. For this reason, the stop of rotation of the ring gear 22 permits the pinion 16 to be engaged with the ring gear 22 as soon as possible. Thus, when determining that rotation of each of the pinion 16 and the ring gear 22 is stopped based on the engine speed NE obtained from the engine speed sensor 23, the engine ECU 30 disables the solenoid 15 from shifting the pinion 16 to the ring gear 22. This makes it possible to efficiently achieve power conservation in the vehicle control system 1.

The vehicle control system 1 according to this embodiment is configured to perform the engagement task in the motor pre-drive mode if an engine restart condition is met during drop of the rotational speed NE of the automatically stopped engine 20. This results in reduction of time required for complete restart of the engine 20.

The present disclosure is not limited to the descriptions of this embodiment, and it can be modified as follows.

It is desirable to restart the engine 20 as soon as possible after cancelling an interrupting request of restart of the engine 20. Thus, the vehicle control system 1 can be configured to perform the restarting task of the engine 20 in response to turnoff of the restart disabling flag after interruption of restart of the engine 20 independently of whether an engine restart condition is met.

For example, in step S04*a*, the engine ECU 30 determines whether an engine restart condition is met or the restart disabling flag is shifted from ON to OFF. Upon determination that either an engine restart request is met or the restart disabling flag is shifted from ON to OFF (YES in step S04*a*), the engine ECU 30 carries out the operation in step S05 set forth above.

That is, upon determination that the restart disabling flag is shifted from ON to OFF (YES in step S04*a*), the engine ECU 30 serves as a forcible cranking module to perform the operation in step S05 set forth above even if no engine restart requests are generated.

Otherwise, neither an engine restart request is met nor the restart disabling flag is shifted from ON to OFF (NO in step S04*a*), the engine ECU 30 terminates the engine stop-and-restart task.

In step S16, the engine ECU 30 changes the state of the solenoid 15 from the energized state to the deenergized state as long as the engine speed NE has been 0 [rpm], but the engine ECU 30 can change the state of the solenoid 15 from the energized state to the deenergized state as long as the engine speed NE becomes equal to or lower than a preset value.

In step S16, the engine ECU 30 can change the state of the solenoid 15 from the energized state to the deenergized state at the timing when a preset time period has elapsed since the engine speed NE became 0 [rpm].

After engagement of the pinion 16 with the ring gear 22, the engine ECU 30 can keep the solenoid 15 in the energized state until completion of restart of the engine 20. This modification eliminates the need to shift the pinion 16 to the ring gear 22 during re-restart of the engine 20 after interruption of restart of the engine 20, resulting in reduction of the time required for the re-restart of the engine 20.

While the pinion 16 is rotated by the motor 11 with engagement of the pinion 16 with the ring gear 22, a part of the tooth portion of the pinion 16 is pushed to abut on a corresponding part of the tooth portion of the ring gear 22, so that friction force is generated between a part of the tooth portion of the pinion 16 and a corresponding part of the tooth portion of the ring gear 22. Thus, the engagement of the pinion 16 with the ring gear 22 can be maintained although shutdown of power supply to the solenoid 15. In view of the feature, the engine ECU 30 can serves as the deenergizing module M2 to:

deenergize, i.e. shut off, power supply to the solenoid 15 while the motor 11 is rotated with engagement of the pinion 16 with the ring gear 22 (see step S13); and restart power supply to, i.e. energization of, the solenoid 15 to prevent disengagement of the pinion 16 with the ring gear 22 when an interrupting request of restart of the engine 20 is generated so that the motor 11 is deenergized (see step S15).

This modification further reduces power consumption due to engine restart because an interrupting request of restart of the engine 20 during execution of the restarting task of the engine 20 does not always occur.

A quantity of power supply required to engage the pinion 16 with the ring gear 22 is greater than that of power supply required to maintain engagement of the pinion 16 with the ring gear 22. For this reason, it is possible to reduce a quantity of power supply to the solenoid 15 with engagement of the pinion 16 with the ring gear 22 (see the operation in step S13 or S15) in comparison to that of power supply to the solenoid 15 with disengagement of the pinion 16 with the ring gear 22 (see the operation in step S07 or S08). For example, it is possible to reduce a quantity of power supply to the solenoid 15 with engagement of the pinion 16 with the ring gear 22 to the half of that of power supply to the solenoid 15 with disengagement of the pinion 16 with the ring gear 22.

While the illustrative embodiment of the present disclosure has been described herein, the present disclosure is not limited to the embodiment described herein, but includes any and all embodiments having modifications, omissions, combinations (e.g., of aspects across various embodiments), adaptations and/or alternations as would be appreciated by those in the art based on the present disclosure. The limitations in the claims are to be interpreted broadly based on the language employed in the claims and not limited to examples described in the present specification or during the prosecution of the application, which examples are to be construed as non-exclusive.

What is claimed is:

1. A system for cranking an internal combustion engine with an output shaft to which a ring gear is coupled, the system comprising:

a starter comprising a mechanism that shifts a pinion to the ring gear to be engageable with the ring gear when energized, a motor that rotates the pinion when energized, and a controller configured to:

execute an engine restart task to crank the internal combustion engine if an engine restart condition is met, the engine restart task including energization of the mechanism to thereby shift the pinion to be engaged with the ring gear, and energization of the motor to rotate the pinion;

deenergize the motor if an interrupting request that interrupts restart of the internal combustion engine is generated during execution of the engine restart task;

maintain energization of the mechanism to engage the pinion with the ring gear even if the interrupting request that interrupts restart of the internal combustion engine is generated during execution of the engine restart task;

determine whether a rotational speed of one of the pinion and the ring gear becomes zero with engagement of the pinion with the ring gear after interruption of the restart of the internal combustion engine; and deenergize the mechanism upon determination that the rotational speed of one of the pinion and the ring gear is zero with engagement of the pinion with the ring gear after interruption of the restart of the internal combustion engine.

2. The system according to claim 1, wherein the controller is further configured to:

maintain energization of the mechanism upon determination that the rotational speed of one of the pinion and the ring gear is not zero.

3. The system according to claim 1, wherein:

the controller is further configured to execute the engine restart task to:

start energization of the motor to rotate the pinion if the engine restart condition is met during drop of rotation of the internal combustion engine, and start energization of the mechanism to shift the pinion to be engaged with the ring gear while a difference between a peripheral speed of a tooth portion of the pinion and a peripheral speed of a tooth portion of the ring gear is equal to or lower than a preset value.

4. The system according to claim 1, wherein the controller is further configured to:

perform, upon the interrupting request being cancelled after generation of the interruption request, at least one of energization of the motor and energization of the mechanism to perform a corresponding at least one of rotation of the pinion and shift of the pinion to be engaged with the ring gear independently of whether the engine restart condition is met.

5. The system according to claim 1, wherein:

the controller is further configured to:

deenergize the mechanism after engagement of the pinion with the ring gear; and energize the mechanism upon the generation of the interrupting request.

6. The system according to claim 1, further comprising:

an interrupting request generator configured to generate the interrupting request that interrupts restart of the internal combustion engine, and outputs the interrupting request to the controller.

7. The system according to claim 6, wherein the system is installed in a motor vehicle, and the interrupting request generator is an ABS unit for braking the motor vehicle while preventing a wheel of the motor vehicle from locking up.

* * * * *